US006794123B2

(12) United States Patent
Uytterhoeven et al.

(10) Patent No.: US 6,794,123 B2
(45) Date of Patent: Sep. 21, 2004

(54) AQUEOUS DISPERSION COMPRISING PHOTOSENSITIVE SILVER HALIDE AND A SUBSTANTIALLY LIGHT-INSENSITIVE SILVER SALT OF AN ORGANIC CARBOXYLIC ACID

(75) Inventors: Herman Uytterhoeven, Bonheiden (BE); Luc Vissers, Brecht (BE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/934,806

(22) Filed: Aug. 22, 2001

(65) Prior Publication Data

US 2002/0055074 A1 May 9, 2002

Related U.S. Application Data

(60) Provisional application No. 60/244,348, filed on Oct. 27, 2000.

(30) Foreign Application Priority Data

Sep. 11, 2000 (EP) ..... 00203137

(51) Int. Cl.[7] ..... G03C 1/498; G03C 1/00
(52) U.S. Cl. ..... 430/619; 430/617; 430/620
(58) Field of Search ..... 430/620, 567, 430/617, 619, 569

(56) References Cited

U.S. PATENT DOCUMENTS 4,210,717 A 7/1980 Gatzke
5,891,616 A * 4/1999 Gilliam et al. ..... 430/617
6,391,537 B2 * 5/2002 Lelental et al. ..... 430/620

FOREIGN PATENT DOCUMENTS

WO WO 97/04355 A1 2/1997

OTHER PUBLICATIONS

U.S. patent application Ser. No. 09/939,941, Uytterhoeven et al., filed Aug. 27, 2001.
U.S. patent application Ser. No. 09/928,755, Uytterhoeven et al., filed Aug. 13, 2001.

* cited by examiner

*Primary Examiner*—Thorl Chea
(74) *Attorney, Agent, or Firm*—Leydig, Voit & Mayer, Ltd.

(57) ABSTRACT

A preparation process for a first aqueous dispersion comprising an ex-situ photosensitive silver halide and a substantially light-insensitive silver salt of an organic carboxylic acid, comprising the steps of: separately preparing a second aqueous dispersion comprising the ex-situ photosensitive silver halide and a third aqueous dispersion comprising the substantially light-insensitive silver salt of an organic carboxylic acid; and mixing the second aqueous dispersion with the third aqueous dispersion to produce a mixture thereof, characterized in that the first aqueous dispersion thereby produced is substantially free of a water-soluble metal or ammonium salt of an aliphatic carboxylic acid with greater than 12 carbon atoms and the process further comprises a step selected from the group consisting of: increasing the pH of the second aqueous dispersion to a value of at least 8.0 prior to mixing with the third aqueous dispersion; increasing the pH of the third aqueous dispersion to a value of at least 8.0 prior to mixing with the second aqueous dispersion; and increasing the pH of the mixture to a value of at least 8.0; the first aqueous dispersion obtainable therewith; and the use thereof in preparing a photo-addressable thermally developable element of a photothermographic material. A preparation process for a fourth aqueous dispersion is also provided.

17 Claims, No Drawings

AQUEOUS DISPERSION COMPRISING PHOTOSENSITIVE SILVER HALIDE AND A SUBSTANTIALLY LIGHT-INSENSITIVE SILVER SALT OF AN ORGANIC CARBOXYLIC ACID

The application claims the benefit of U.S. Provisional Application No. 60/244,348 filed Oct. 27, 2000.

FIELD OF THE INVENTION

The present invention relates to an aqueous dispersion comprising photosensitive silver halide and a substantially light-insensitive silver salt of an organic carboxylic acid and the preparation and use thereof.

BACKGROUND OF THE INVENTION

U.S. Pat. No. 4,210,717 states that preparation processes for dispersions containing photosensitive silver halide and organic silver salts which allow the pH of the dispersion to rise above 9.0 using alkali salts of alkali or ammonium salts of organic acids such as disclosed in U.S. Pat. No. 3,761,273 and DOS 28 24 556 (=U.S. patent application Ser. No. 803,549, filed Jun. 6, 1977) give rise to silver hydroxide during the processes and to a loss of silver due to precipitation of silver hydroxide. U.S. Pat. No. 4,210,717 discloses a preparation process for dispersions of photosensitive silver halide and half soaps of organic acids and silver salts of organic acids in which a pH of less than 9.0 is maintained to improve the conversion percentage and improve the general quality thereof. It is well known that hydrolysis of silver halides to silver hydroxide and silver oxide give rise to increased background densities in conventional silver halide emulsions, see e.g. The Theory of the Photographic Process Fourth Edition, Ed. T. H. James, Eastman Kodak (1977), page 395, and hence the silver oxide formed at high pH's would also be expected to give rise to increased background and in general reduced stability in the background density in photothermographic materials.

WO 97/04355 discloses a photothermographic recording material, comprising a support and a photo-addressable thermally developable element comprising photosensitive silver halide in catalytic association with a substantially light-insensitive silver salt of an organic carboxylic acid, an organic reducing agent for said substantially light-insensitive silver salt of an organic carboxylic acid in thermal working relationship therewith and a binder, characterized in that said binder comprises a non-proteinaceous water-soluble binder, a non-proteinaceous water-dispersible binder or a mixture of a non-proteinaceous water-soluble binder and a non-proteinaceous water-dispersible binder. The emulsion used for coating the photographic silver behenate emulsion layer of invention example number 40 has a pH well below 8 as can be adduced from the pH's disclosed for the ingredients used.

In photothermographic materials in which both partners of the oxidation-reduction reaction forming the elemental silver particles which make up the image are still present after image development, there is a constant demand for ways of stabilizing these materials both before and after image formation without the necessity for lengthy conditioning at elevated temperatures and high relative humidities.

OBJECTS OF THE INVENTION

It is an object of the instant invention to provide an aqueous dispersion comprising photosensitive silver halide and substantially light-insensitive silver salt of an organic carboxylic acids capable of being used in the preparation of photothermographic materials with improved stability of the background density without the necessity for lengthy conditioning at elevated temperatures and high relative humidities.

It is a further object of the invention to provide a process for preparing an aqueous dispersion comprising photosensitive silver halide and substantially light-insensitive silver salt of an organic carboxylic acids capable of being used in the preparation of photothermographic materials with improved stability of the background density without the necessity for lengthy conditioning at elevated temperatures and high relative humidities.

It is a still further object of the invention to provide a photothermographic recording material with improved stability of the background density without the necessity for lengthy conditioning at elevated temperatures and high relative humidities.

Further objects and advantages of the invention will become apparent from the description hereinafter.

SUMMARY OF THE INVENTION

Surprisingly it has been found that by increasing the pH of aqueous dispersions comprising photosensitive silver halide and substantially light-insensitive silver salt of an organic carboxylic acids temporarily to a pH at or above 8.0, that photothermographic recording materials coated with such dispersions exhibit a substantial reduction in background density and an improvement in the stability of the background density without the necessity for lengthy conditioning at elevated temperatures and high relative humidities.

The above-mentioned objects are realized by a preparation process for a first aqueous dispersion comprising an ex-situ photosensitive silver halide and a substantially light-insensitive silver salt of an organic carboxylic acid, comprising the steps of: separately preparing a second aqueous dispersion comprising the ex-situ photosensitive silver halide and a third aqueous dispersion comprising the substantially light-insensitive silver salt of an organic carboxylic acid; and mixing the second aqueous dispersion with the third aqueous dispersion to produce a mixture thereof, characterized in that the first aqueous dispersion thereby produced is substantially free of a water-soluble metal or ammonium salt of an aliphatic carboxylic acid with greater than 12 carbon atoms and the process further comprises a step selected from the group consisting of: increasing the pH of the second aqueous dispersion to a value of at least 8.0 prior to mixing with the third aqueous dispersion; increasing the pH of the third aqueous dispersion to a value of at least 8.0 prior to mixing with the second aqueous dispersion; and increasing the pH of the mixture to a value of at least 8.0.

The above-mentioned objects are further realized by a first aqueous dispersion comprising an ex-situ photosensitive silver halide and a substantially light-insensitive silver salt of an organic carboxylic acid obtainable by the above-mentioned preparation process.

The above-mentioned objects are also realized by the use of the above-mentioned first aqueous dispersion in preparing a photo-addressable thermally developable element of a photothermographic recording material, the photo-addressable thermally developable element comprising the photosensitive silver halide, the substantially light-insensitive silver salt of an organic carboxylic acid, a reducing agent therefor in thermal working relationship therewith and a binder.

The above-mentioned objects are also realized by a preparation process for a fourth aqueous dispersion comprising a second in-situ photosensitive silver halide and a substantially light-insensitive silver salt of an organic carboxylic acid, comprising the steps of: (I) providing the above-described third aqueous dispersion and (II) partially converting the substantially light-insensitive silver salt of an organic carboxylic acid in the third aqueous dispersion with a non-fluoro halide ion source into the second in-situ photosensitive silver halide thereby producing the fourth aqueous dispersion; characterized in that the fourth aqueous dispersion thereby produced is substantially free of a water-soluble metal or ammonium salt of an aliphatic carboxylic acid with greater than 12 carbon atoms and the process further comprises a step selected from the group consisting of: increasing the pH of the third aqueous dispersion to a value of at least 8.0 prior to step (II); increasing the pH of the third aqueous dispersion to a value of at least 8.0 during step (II); and increasing the pH of the aqueous dispersion resulting from step (II) to a value of at least 8.0.

The above-mentioned objects are also realized by a fourth aqueous dispersion comprising a second in-situ photosensitive silver halide and a substantially light-insensitive silver salt of an organic carboxylic acid obtainable by the above-mentioned preparation process.

The above-mentioned objects are also realized by, the use of the above-mentioned fourth aqueous dispersion in preparing a photo-addressable thermally developable element of a photothermographic recording material, the photo-addressable thermally developable element comprising the photosensitive silver halide, the substantially light-insensitive silver salt of an organic carboxylic acid, a reducing agent therefor in thermal working relationship therewith and a binder.

Further preferred embodiments of the present invention are disclosed in the dependent claims.

DETAILED DESCRIPTION OF THE INVENTION

Definitions

The term aqueous for the purposes of the present invention means containing at least 60% by volume of water, preferably at least 80% by volume of water, and optionally containing water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

The term water-soluble salt means salts with a solubility in water at 20° C. of at least 2 mg/L. The term metal or ammonium salt of an aliphatic carboxylic acid with greater than 12 carbon atoms, includes lithium, potassium, sodium, rubidium, caesium and ammonium salts of aliphatic carboxylic acids, such as behenic and stearic acid, and mixtures thereof.

Substantially free of means not intentionally present and if present only present in trace quantities.

Substantially light-insensitive means not intentionally light sensitive and resistant to darkening upon exposure.

The UAg of an aqueous liquid is defined in this specification as the potential difference between a silver electrode (of 99.99% purity) in the aqueous liquid and a reference electrode consisting of a Ag/AgCl-electrode in 3 M KCl solution at room temperature connected with the liquid via a salt bridge consisting of a 10% $KNO_3$ salt solution.

S is defined as that exposure in $mJ/m^2$ at which the photothermographic recording material attained an optical density of 1.0 above Dmin. Thus the lower the value of S, the higher the photosensitivity of the photothermographic recording material.

By the term "heat solvent" in this specification is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the first silver salt, at a temperature above 60° C.

By thermally developable under substantially water-free conditions as used is the present specification, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977, page 374.

Terminology used for the Photosensitive Silver Halide Used in the Aqueous Dispersions of the Present Invention The term photosensitive silver halide covers in-situ photosensitive silver halide, ex-situ photosensitive silver halide and mixtures of in-situ and ex-situ photosensitive silver halides.

Ex-situ photosensitive silver halide means photosensitive silver halide not prepared by the partial conversion of an organic silver salt by reaction with a non-fluoro halide ion source.

In-situ photosensitive silver halide means photosensitive silver halide prepared by the partial conversion of an organic silver salt by reaction with a non-fluoro halide ion source.

The terms first in-situ photosensitive silver halide and second in-situ photosensitive silver halide refer to the first mentioned and second mentioned in-situ silver halides, which can be the same or different.

Photosensitive Silver Halide

The photosensitive silver halide used the present invention may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive silver salt of an organic carboxylic acid.

So-called in-situ silver halide can be prepared by conversion of a substantially light-insensitive silver salt of an organic carboxylic acid with a non-fluoro halide ion source such as described in U.S. Pat. No. 3,457,075, WO 97/48104 and WO 97/48105.

Silver Salt of an Organic Carboxylic Acid

The substantially light-insensitive silver salt of an organic carboxylic acid has as its organic group: aryl, aralkyl, alkaryl or alkyl groups. Aliphatic carboxylic acids known as fatty acids, wherein the aliphatic carbon chain has preferably at least 12 C-atoms, are preferred e.g. silver laurate, silver palmitate, silver stearate, silver hydroxystearate, silver oleate, silver behenate and silver arichidate, which silver salts are also called "silver soaps". Other silver salts of an organic carboxylic acid as described in GB 1,439,478, e.g. silver benzoate, and silver salts of organic carboxylic acids described in Research Disclosure 17029, but excluding silver salts of organic carboxylic acids substituted with a heterocyclic thione group as disclosed in Research Disclosure 12542 and U.S. Pat. No. 3,785,830, may also be used to produce a thermally developable silver image. Combinations of the first silver salts may also be used in the present invention. Aqueous dispersions of first silver salts or mixtures thereof can be produced as described in U.S. Pat. No. 5,891,616 and EP-A 848286 and U.S. Pat. No. 3,839,049.

Terminology used for the Aqueous Dispersions of the Present Invention

The terms first aqueous dispersion, second aqueous dispersion, third aqueous dispersion and fourth aqueous dispersion refer to different dispersions. The terms first, second, third and fourth are short-hand for first mentioned, second mentioned, third mentioned and fourth mentioned and are used to unambiguously identify the aqueous dispersion being referred to.

First Aqueous Dispersion Comprising Ex-situ Photosensitive Silver Halide and a Substantially Light-insensitive Silver Salt of an Organic Carboxylic Acid The first aqueous dispersion incorporates so-called ex-situ silver halide in which ex-situ silver halide is either mixed with particles of substantially light-insensitive silver salt of an organic carboxylic acid or is present during the preparation of the particles of substantially light-insensitive silver salt of an organic carboxylic acid as disclosed in U.S. Pat. No. 3,839,049. The first aqueous dispersion may further comprise a first in situ photosensitive silver halide.

The processes for preparing the first aqueous dispersion comprising photosensitive silver halide and a substantially light-insensitive silver salt or an organic carboxylic acid, according to the present invention, all involve a step in which a pH of at least 8.0 is attained during the preparation process. This brings about the surprising result of achieving at least Dmin stabilization without resorting to conditioning at elevated temperatures and high relative humidities, neglible drift in Dmin being observed in the dark over a week at 20° C. and ca. 45% relative humidity. It is preferred that this pH value be realized with ammonia either as gaseous ammonia or as an aqueous ammonia solution. The pH value should preferably not rise above a value of 10.5 during the preparation process.

The process for preparing the first aqueous dispersion, according to the present invention, preferably also includes the addition of a water-soluble silver salt having a solubility in water at 20° C. of greater than 0.1 g/L at any stage of the preparation process.

Second Aqueous Dispersion Comprising an Ex-situ Photosensitive Silver Halide The second aqueous dispersion comprising an ex-situ photosensitive silver halide can be produced using conventional dispersion techniques such as described in Chapter III of "The Theory of the Photographic Process Fourth Edition, Ed. T. H. James, Eastman Kodak (1977)".

Third Aqueous Dispersion Comprising a Substantially Light-insensitive Silver Salt of an Organic Carboxylic Acid Research Disclosure number 17029, published in June 1978, in section II gives a survey of different methods of preparing organic silver salts. In order to obtain a fine dispersion of an organic silver salt, either the synthesis has to be carried out in an organic solvent medium as disclosed, for example, in U.S. Pat. No. 3,700,458 or in a mixture of water and a substantially water insoluble organic solvent as disclosed, e.g., in U.S. Pat. No. 3,960,908 for silver carboxylates.

To obtain the third aqueous dispersion comprising such substantially light-insensitive silver salt of an organic carboxylic acids, any conventional dispersion techniques may be used, for example ball milling, microfluidization, pearl mills etc. together with anionic surfactants, non-ionic surfactants and/or dispersion agents. Alternatively the third aqueous dispersion comprising a substantially light-insensitive silver salt of an organic carboxylic acid can be produced directly such as disclosed in EP-A 848 286 and EP-A 754 969.

Fourth Aqueous Dispersion Comprising a Second In-situ Photosensitive Silver Halide and a Substantially Light-insensitive Silver Salt of an Organic Carboxylic Acid The processes for preparing the first aqueous dispersion comprising photosensitive silver halide and a substantially light-insensitive silver salt of an organic carboxylic acid, according to the present invention, all involve a step in which a pH of at least 8.0 is attained during the preparation process. This achieves the surprising result of achieving at least Dmin stabilization without resorting to conditioning at elevated temperatures and high relative humidities, neglible drift in Dmin being observed in the dark over a week at 20° C. and ca. 45% relative humidity. It is preferred that this pH value be realized with ammonia either as gaseous ammonia or as an aqueous ammonia solution. The pH value should preferably not rise above a value of 10.5 during the preparation process.

The process for preparing the fourth aqueous dispersion, according to the present invention, preferably also includes the addition of a water-soluble silver salt having a solubility in water at 20° C. of greater than 0.1 g/L at any stage of the preparation process.

Water-soluble Silver Salt

Whereas in convention photographic emulsions addition of a water-soluble silver salt to a dispersion of photosensitive silver halide prior to coating produces a photographic material with a very high fogging level, it has been surprisingly found that the addition of a silver salt with a water-solubility greater than 0.1 g/L water to an aqueous dispersion of a substantially light-insensitive and substantially water-insoluble organic silver salt and a photosensitive silver halide surprisingly produced much lower S-values and hence much higher photosensitivities than those observed in the case of the addition of ammonia or the soluble silver salt alone, while having only a marginal effect on the background density of prints produced therewith.

Preferred water-soluble silver salts have a solubility in water at 20° C. of greater than 1 g/L.

Suitable water-soluble silver salts according to the present invention include silver nitrate, silver acetate, silver propionate, silver sulfate, silver butyrate, silver isobutyrate, silver benzoate, silver tartrate, silver salicylate, silver malonate, silver succinate and silver lactate, with water-soluble silver salts selected from the group consisting of silver nitrate, silver acetate, silver lactate and silver sulfate being preferred.

It is known in silver halide photography that addition of soluble silver salts to a dispersion of a silver halide produces an increase in UAg (=decrease in pAg=an increase in free silver ion concentration), which can result in partial reduction of the silver salts present, thereby producing metallic silver nuclei. Such metallic silver nuclei give rise to an increased fogging level in silver halide photographic materials. It is possible that an analogous effect is the basis for the sensitivity increase arising from the addition of water-soluble silver salt.

Photo-addressable Thermally Developable Element

According to the present invention, the photothermographic recording material of the present invention comprises a support and a photo-addressable thermally developable element, which fulfils two requirements: (i) it contains a first silver salt, a reducing agent for the first silver salt in thermal working relationship therewith, a photosensitive silver halide and a binder; and (ii) it comprises a layer obtainable by coating a first aqueous dispersion or a fourth aqueous dispersion, according to the present invention.

These two requirements will overlap in that the first aqueous dispersion contains an ex-situ photosensitive silver halide and a third aqueous dispersion comprising the substantially light-insensitive silver salt of an organic carboxylic acid and optionally contains a reducing agent for the substantially light-insensitive silver salt of an organic carboxylic acid, a spectral sensitizer, a supersensitizer, one or more stabilizers and a binder; or the fourth aqueous dispersion contains the above-mentioned third aqueous emulsion partially converted into a second in-situ photosensitive silver halide and optionally contains a reducing agent for the substantially light-insensitive silver salt of an organic carboxylic acid, a spectral sensitizer, a supersensitizer, one or more stabilizers and a binder.

The photo-addressable thermally developable element may comprise a single layer, i.e. produced with the aqueous dispersion according to the present invention, or may comprise more than one layer, one of which is produced with the first or fourth aqueous dispersion and the other layers containing the other ingredients necessary for image formation e.g. a reducing agent for the first silver salt, a binder, a toning agent and one or more stabilizers. In this layer system the photosensitive silver halide should be in catalytic association with the substantially light-insensitive silver salt of an organic carboxylic acid, the spectral sensitizer should be optionally together with a supersensitizer in intimate sensitizing association with the silver halide particles and the other ingredients active in the thermal development process or pre- or post-development stabilization of the element should be in the same layer or in other layers with the proviso that the organic reducing agent and the toning agent, if present, should be in thermal working relationship with the substantially light-insensitive silver salt of an organic carboxylic acid i.e. during the thermal development process the reducing agent and the toning agent, if present, are able to diffuse to the substantially light-insensitive silver salt of an organic carboxylic acid.

The photo-addressable thermally developable element may also be coated with a protective layer.

Organic Reducing Agents

Suitable organic reducing agents for the reduction of substantially light-insensitive silver salt of an organic carboxylic acids are organic compounds containing at least one active hydrogen atom linked to O, N or C, such as is the case with: aromatic di- and tri-hydroxy compounds; aminophenols; METOL™; p-phenylene-diamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130

Binders for the Photo-addressable Thermally Developable Element

The film-forming binder for use in the aqueous dispersions and photo-addressable thermally developable element of the present invention may a water-dispersible or a water-soluble binder.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

Suitable water-dispersible binders are any water-insoluble polymers e.g. water-insoluble cellulose derivatives, polyurethanes, polyesters polycarbonates and polymers derived from α,β-ethylenically unsaturated compounds such as after-chlorinated polyvinyl chloride, partially hydrolyzed polyvinyl acetate, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof.

It should be noted that there is no clear cut transition between a polymer dispersion and a polymer solution in the case of very small polymer particles resulting in the smallest particles of the polymer being dissolved and those slightly larger being in dispersion.

Water-dispersible binders with crosslinkable groups, e.g. epoxy groups, aceto-acetoxy groups and crosslinkable double bonds are also preferred. Preferred water-dispersible binders for use in the photo-addressable thermally developable element of the present invention are polymer latexes as disclosed in WO 97/04355.

The above mentioned binders or mixtures thereof may be used in conjunction with waxes or "heat solvents" also called "thermal solvents" or "thermosolvents" improving the reaction speed of the redox-reaction at elevated temperature.

Spectral Sensitizer

The photo-addressable thermally developable element of the photothermographic recording material and aqueous dispersions, according to the present invention, may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infrared radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

According to the present invention the photo-addressable thermally developable element and aqueous dispersions may further include a supersensitizer. Preferred supersensitizers are selected from the group of compounds consisting of: mercapto-compounds, disulfide-compounds, stilbene compounds, organoborate compounds and styryl compounds.

Toning Agents

In order to obtain a neutral black image tone in the higher densities and neutral grey in the lower densities, the photo-addressable thermally developable element and aqueous dispersions according to the present invention may contain one or more toning agents. The toning agents should be in thermal working relationship with the substantially light-insensitive silver salt of an organic carboxylic acid and the reducing agents therefor during thermal processing.

Stabilizers and Antifoggants

In order to obtain further improvement in shelf-life and background density level, stabilizers and antifoggants may be incorporated into the photo-addressable thermally developable elements and aqueous dispersions of the present invention.

Support

The support for the photothermographic recording material and aqueous dispersions according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Antihalation Dyes

The photothermographic recording materials used in the present invention may also contain antihalation or acutance dyes which absorb light which has passed through the photosensitive thermally developable photographic material, thereby preventing its reflection. Such dyes may be incorporated into the photo-addressable thermally developable element or in any other layer of the photothermographic material of the present invention.

Antistatic Layer

In a preferred embodiment the photothermographic recording material of the present invention an antistatic layer is applied to an outermost layer.

Surfactants and Dispersants

Surfactants are surface active agents which are soluble compounds which reduce the interfacial tension between a liquid and a solid. The aqueous dispersions of the present invention may contain anionic, non-ionic or amphoteric surfactants, with anionic and non-ionic surfactants preferred as disclosed in WO 97/04356. Suitable dispersants are natural polymeric substances, synthetic polymeric substances and finely divided powders, for example finely divided non-metallic inorganic powders such as silica.

Coating

The coating of any layer of the aqueous dispersions of the present invention may proceed by any coating technique e.g.

such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Photothermographic recording materials according to the present invention may be used for both the production of transparencies, for example in the medical diagnostic field in which black-imaged transparencies are widely used in inspection techniques operating with a light box, reflection type prints, for example in the hard copy graphics field and in microfilm applications. For such applications the support will be transparent or opaque, i.e. having a white light reflecting aspect. Should a transparent base be used, the base may be colourless or coloured, e.g. with a blue colour for medical diagnostic applications.

The invention is described hereinafter by way of INVENTION EXAMPLES 1 to 6 and COMPARATIVE EXAMPLES 1 and 2 in which all percentages are percentages by weight unless otherwise specified and the following ingredients were used:

photo-addressable thermally developable element:

R16875=R16875, a phthaloyl gelatine from ROUSSELOT;

K7598=Type 7598, a calcium-free gelatin from AGFA-GEVAERT GELATINEFABRIEK;

AgB=silver behenate

LOWINOX 22IB46=2-propyl-bis(2-hydroxy-3,5-dimethylphenyl)methane from CHEM. WERKE LOWI;

SENSI 01=

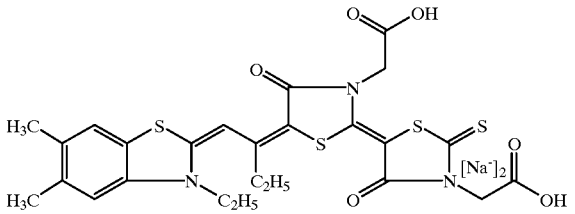

Surfactant Nr. 1=MARLON™ A-396, a sodium alkylphenylsulfonate from Hüls;

Surfactant Nr. 2=ERKANTOL™ BX, a sodium disopropylnaphthalenesulfonate from BAYER;

Surfactant Nr. 3=ULTRAVON™ W, supplied as a 75–85% concentrate of a sodium arylsulfonate by CIBA-GEIGY;

STABI 01=

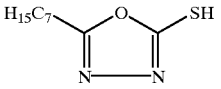

STABI 02=4-methyl-phthalic acid; and

STABI 03=phenyl tribromomethyl sulfone.

TA01=phthalazine;

antihalation layer:

K7598=Type 7598, a calcium-free gelatin from AGFA-GEVAERT GELATINEFABRIEK vorm. KOEPFF & SÖHNE;

KIESELSOL 300F=a 30% aqueous dispersion of colloidal silica from BAYER; and

LATEX 01=a poly(ethylacrylate) latex.

ANTIHALO 01

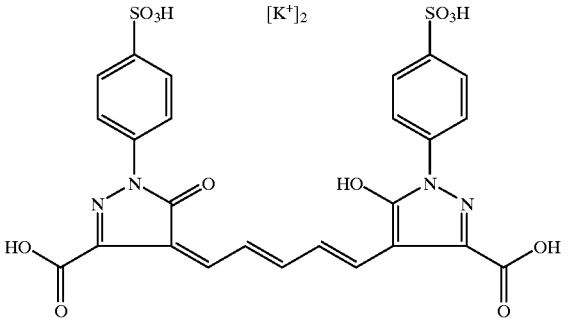

protective layer:

K7598=Type 7598, a calcium-free gelatin from AGFA-GEVAERT GELATINEFABRIEK;

Surfactant Nr. 4=ammonium salt of perfluoro-octanoic acid.

Preparation of Photosensitive Silver Halide

The silver halide emulsion consisting of 11.44% by weight of 100 mol % silver bromide with a weight average particle size of 73 nm as measured with the Moeller Teller method (see above for details) and 5.17% by weight of R16875 as dispersing agent in deionized water was prepared using conventional silver halide preparation techniques at 50.5° C. such as described, for example, in T. H. James, "The Theory of the Photographic Process", Fourth Edition, Macmillan Publishing Co. Inc., New York (1977), Chapter 3, pages 88–104.

INVENTION EXAMPLES 1 to 6 & COMPARATIVE EXAMPLES 1 and 2

Preparation of Silver Behenate Dispersions in an Aqueous Medium in the Absence of Organic Solvent Using a Single Jet Process The aqueous dispersion of silver behenate used in INVENTION EXAMPLES 1 and 6 and COMPARATIVE EXAMPLES 1 and 2 was produced as follows:

i) dispersing 136.2 g (0.4 M) behenic acid with stirring at 310 rpm with a 80 mm diameter typhoon stirrer in a 200 mm diameter vessel at 80° C. in a quantity of 549 mL of a 10% solution of Surfactant nr 1 and 662 g of deionized water at a temperature of 80° C.;

ii) then adding 188 mL of a 2 M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 360 mL of a 1 M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant 1 and was subsequently desalted and concentrated using ultrafiltration to an aqueous dispersion containing 22.37% by weight of silver behenate.

Preparation of Aqueous Dispersions 26.2 g of K7598 was dissolved in 150 g of deionized water at 40° C. To this gelatin solution 19.35 g of a 11.44% by weight dispersion of silver halide was then added over a period of 20s with stirring corresponding to 11.7 mmol of silver halide. Then the quantities of ammonia given in Table 1 were added as a 2.5% by weight aqueous solution before, simultaneously with or after the quantity of silver nitrate given in Table 1 for the particular EXAMPLE was added as a 3.56% by weight aqueous solution and the resulting dispersion was made up to 265.4 g with demineralized water while maintaining the temperature at 40° C.

TABLE 1

| Example | AgNO, added as aq. solution | | NH, added as aqueous solution | |
|---|---|---|---|---|
| nr | how? | [mmol] | how? | [mmol] |
| Comp. 1 | — | 0 | — | 0 |
| Inv. 1 | — | 0 | — | 14.7 |
| Inv. 2 | — | 0 | — | 22.1 |
| Comp. 2 | — | 4.19 | — | 0 |
| Inv. 3 | with $NH_3$ | 4.19 | with $AgNO_3$ | 22.1 |
| Inv. 4 | with $NH_3$ | 4.19 | with $AgNO_3$ | 14.7 |
| Inv. 5 | before $NH_3$ | 4.19 | after $AgNO_3$ + 30 min stirring | 14.7 |
| Inv. 6 | after $NH_3$ + 30 min stirring | 4.19 | before $AgNO_3$ | 14.7 |

After stirring for 1 hour at 40° C. a UAg measurement was carried out (UAg-1) then 206.6 g of the above-described silver behenate dispersion was added together with 2.4 g of 1 N nitric acid and after a further 20 minutes stirring at 40° C. a second UAg measurement (UAg-2) was carried out. The UAg-1, UAg-2, pH-1 and pH-2 measurements are given in Table 2.

TABLE 2

| Example nr | $AgNO_3$ added as aqueous solution how? | moles/ mol AgX | $NH_3$ added as aqueous solution How? | moles/ mol AgX | UAg-1 [mV] | pH-1 | UAg-2 [mV] | pH-2 |
|---|---|---|---|---|---|---|---|---|
| Comp. 1 | — | 0 | — | 0 | — | — | 299 | — |
| Inv. 1 | — | 0 | — | 1.256 | 73 | 9.0 | 160 | 8.16 |
| Inv. 2 | — | 0 | — | 1.889 | 67 | 9.2 | 143 | 8.62 |
| Comp. 2 | — | 0.358 | — | 0 | 442 | 5.01 | 415 | 5.0 |
| Inv. 3 | with $NH_3$ | 0.358 | with $AgNO_3$ | 1.889 | 245 | 8.9 | 284 | 8.2 |
| Inv. 4 | with $NH_3$ | 0.358 | with $AgNO_3$ | 1.256 | 314 | 8.26 | 357 | 7.27 |
| Inv. 5 | before $NH_3$ | 0.358 | after $AgNO_3$ + 30 min stirring | 1.256 | 325 | 8.18 | 363 | 7.23 |
| Inv. 6 | after $NH_3$ + 30 min stirring | 0.358 | before $AgNO_3$ | 1.256 | 330 | 8.16 | 363 | 7.2 |

After the second UAg measurement the following ingredients were added: 8.7 g of a 4 g/L solution of SENSI 01 followed by 20 minutes stirring, then 11.8 g of a 8% by weight solution in ethanol of STABI 01 and finally just before coating 112 g of a dispersion consisting of 4.68% by weight of phthalazine, 16.84% by weight of LOWINOX 22IB46 and 2% by weight of Surfactant Nr. 2.

Preparation of the Photothermographic Recording Materials

A antihalation layer dispersion was prepared by dissolving 62.5 g of K7598 in 1L of deionized water at 40° C. The following ingredients were then added to the resulting gelatin solution: 14.5 g of a 10% by aqueous weight solution of ANTIHALO 01, 8 g of a 10% by weight aqueous dispersion of LATEX 01, 42 g of a 20% by weight aqueous dispersion of KIESELSOL 300F and finally the pH was adjusted to 6 before doctor-blade coating to a wet-layer thickness of 45 μm on one side of a 100 μm poly(ethylene terephthalate) support subbed on both sides and drying at 25° C. for 5 minutes.

A solution for the first layer of the thermosensitive element was then prepared by dissolving 42.5 g of K7598 in 1928.2 g of deionized water at 40° C. and then adding the following ingredients with stirring: 8.7 g of STABI 02, 179.1 g of a STABI 03-dispersion (consisting of 17.5% by weight of STABI 03, 10% by weight of K7598 and 1% by weight of Surfactant Nr. 1), 6 g of 1-phenyl-5-mercapto-tetrazole dissolved in 227.3 g of methanol and 17.4 g of a 10% solution of Surfactant Nr. 3.

The side of the support not coated with the antihalation layer was then coated with the solution for the first layer of the thermosensitive element to a wet layer thickness of 50 μm to produce after drying at 25° C. for 5 minutes the first layer of the thermosensitive element.

The first layer of the thermosensitive element was then overcoated with the above-described aqueous dispersion to a wet layer thickness of 100 μm to form after drying at 25° C. for 5 minutes the second layer of the thermosensitive element.

Finally the second layer of the thermosensitive element was overcoated with a solution of 57 g of K7598 in 2560 g of deionized water to which 78 g of a 5% by weight solution of Surfactant Nr. 4 had been added to a wet layer thickness of 50 μm to form after drying at 25° C. for 5 minutes a protective layer.

Evaluation of the Photothermographic Recording Materials

The photothermographic recording materials of INVENTIVE EXAMPLES 1 to 6 and COMPARATIVE EXAMPLES 1 and 2 were first exposed to a He—Ne laser (632.8 nm) through a grey scale wedge to vary the exposure of the film and then heated for 20s at 100° C. to produce a wedge image. The print density variation in the wedge image was determined with a MACBETH TD903 densitometer with a visual filter giving the dependence of optical density upon exposure. The S-values, defined as the exposure in mJ/m$^2$ at which an optical density of 1.0 above Dmin was achieved, were determined from these optical density-exposure dependencies. The lower the value of exposure, S, required to obtain an optical density of 1.0 above Dmin, the higher the photosensitivity of the photothermographic material.

Photothermographic evaluation was carried out on freshly coated photothermographic recording materials and also after 1 week in the dark at 20° C. and ca. 45% relative humidity (RH) to determine the change in background density Dmin, ΔDmin, and in S, ΔS. The results of the evaluation of the photothermographic recording materials of INVENTION EXAMPLES 1 to 6 and COMPARATIVE EXAMPLES 1 and 2 are summarized in Table 3 below.

The Dmin and S-values obtained with fresh photothermographic recording materials of INVENTION EXAMPLES 1 and 2 and after 1 week in the dark at 20° C. and ca. 45% relative humidity, in comparison with those obtained with the photothermographic recording material of COMPARATIVE EXAMPLE 1, show that addition of ammonia alone, in quantities of 1.256 to 1.889 moles/mol silver halide, resulted in a much smaller change in Dmin and S-values, as shown by the reduced ΔDmin (+0.13 to +0.15 versus +0.91) and ΔS values (0 to +349 mJ/m$^2$ versus +509 mJ/m$^2$) observed after 1 week in the dark at 20° C. and ca. 45% relative humidity.

The photothermographic recording material of INVENTION EXAMPLE 1 exhibited the best all round performance with the lowest Dmin value for the fresh material and the lowest change in Dmin with a ΔDmin value of +0.15 and a ΔS value of 0 mJ/m$^2$. However, the S-values of 501 and 1000 mJ/m$^2$ for the fresh photothermographic recording materials of INVENTION EXAMPLES 1 and 2 were very high, indicating a low photosensitivity.

The addition of both ammonia and a soluble silver salt such as silver nitrate resulted in the photothermographic recording materials of INVENTION EXAMPLES 3 to 6 with S-values for fresh materials between 79 and 100 mJ/m$^2$ i.e. photosensitivities beyond that achievable with ammonia alone (501 and 1000 mJ/m$^2$ for the fresh photothermographic recording materials of INVENTION EXAMPLES 1 and 2 respectively) or with the soluble silver salt alone (141 mJ/m$^2$ for the fresh photothermographic recording materials of COMPARATIVE EXAMPLE 2). A surprising synergetic effect was thus observed upon the addition of ammonia and a soluble silver salt.

TABLE 3

| Example | fresh material | | after 7d in dark at 20° C./45% RH | |
|---|---|---|---|---|
| Nr | Dmin | S [mJ/m$^2$] | ΔDmin | ΔS [mJ/m$^2$] |
| Comp. 1 | 0.35 | 446 | +0.91 | +509 |
| Inv. 1 | 0.37 | 501 | +0.15 | 0 |
| Inv. 2 | 0.46 | 1000 | +0.13 | +349 |
| Comp. 2 | 0.40 | 141 | +0.57 | 0 |
| Inv. 3 | 0.49 | 100 | +0.16 | +41 |
| Inv. 4 | 0.68 | 79 | +0.07 | +33 |
| Inv. 5 | 0.69 | 89 | +0.08 | +23 |
| Inv. 6 | 0.69 | 89 | +0.15 | +23 |

Addition of ammonia in quantities of 1.256 to 1.889 moles/mol silver halide as an aqueous solution to the aqueous dispersion according to the present invention in addition to silver nitrate thus resulted in photothermographic recording materials, with a considerable reduction in Dmin change, with ΔDmin values of +0.07 to +0.16 after 1 week in the dark at 20° C. and ca. 45% relative humidity (INVENTION EXAMPLES 3 to 6), compared with +0.57 for the photothermographic recording material of COMPARATIVE EXAMPLE 2.

Whether the same quantity of aqueous solution of ammonia was added simultaneously with silver nitrate as in INVENTION EXAMPLES 4, after the addition of the silver nitrate as in INVENTION EXAMPLE 5 or before the addition of the second silver salt as in INVENTION EXAMPLE 6, was found to have no influence, within experimental error, on the imaging performance of the resulting photothermographic recording materials (see the results in Table 3).

Having described in detail preferred embodiments of the current invention, it will now be apparent to those skilled in the art that numerous modifications can be made therein without departing from the scope of the invention as defined in the following claims.

What is claimed is:

1. A preparation process for a first aqueous dispersion comprising an ex-situ photosensitive silver halide and a substantially light-insensitive silver salt of an organic carboxylic acid, comprising the steps of: separately preparing a second aqueous dispersion comprising said ex-situ photosensitive silver halide and a third aqueous dispersion comprising said substantially light-insensitive silver salt of an organic carboxylic acid; and mixing said second aqueous dispersion with said third aqueous dispersion to produce a mixture thereof, wherein said first aqueous dispersion thereby produced is substantially free of a water-soluble metal or ammonium salt of an aliphatic carboxylic acid with greater than 12 carbon atoms and said process further comprises a step selected from the group consisting of: increasing the pH of said second aqueous dispersion to a value of at least 8.0 prior to mixing with said third aqueous dispersion; increasing the pH of said third aqueous dispersion to a value of at least 8.0 prior to mixing with said second aqueous dispersion; and increasing the pH of said mixture to a value of at least 8.0.

2. Preparation process according to claim 1, wherein said third aqueous dispersion further comprises a first in situ photosensitive silver halide.

3. Preparation process according to claim 1, wherein said pH value of at least 8.0 is attained by addition of ammonia.

4. Preparation process according to claim 1, wherein said substantially light-insensitive silver salt of an organic carboxylic acid is a silver salt of an aliphatic carboxylic acid greater than 12 carbon atoms.

5. Preparation process according to claim 1, wherein said process further includes a step of adding a water-soluble silver salt having a solubility in water at 20° C. of greater than 0.1 g/L at any stage in said preparation process.

6. A first aqueous dispersion comprising an ex-situ photosensitive silver halide and a substantially light-insensitive silver salt of an aliphatic carboxylic acid with greater than 12 carbon atoms and having a pH at or above 8.0 obtained by a process comprising the steps of: separately preparing a second aqueous dispersion comprising said ex-situ photosensitive silver halide and a third aqueous dispersion comprising said substantially light-insensitive silver salt of an organic carboxylic acid; and mixing said second aqueous dispersion with said third aqueous dispersion to produce a mixture thereof, wherein said first aqueous dispersion thereby produced is substantially free of a water-soluble metal or ammonium salt of an aliphatic carboxylic acid with greater than 12 carbon atoms and said process further comprises a step selected from the group consisting of: increasing the pH of said second aqueous dispersion to a value of at least 8.0 prior to mixing with said third aqueous dispersion; increasing the pH of said third aqueous dispersion to a value of at least 8.0 prior to mixing with said second aqueous dispersion; and increasing the pH of said mixture to a value of at least 8.0.

7. First aqueous dispersion according to claim 6, wherein said first aqueous dispersion further contains a reducing agent for said substantially light-insensitive silver salt of an aliphatic carboxylic acid with greater than 12 carbon atoms.

8. A process for preparing a layer of a photo-addressable thermally developable element of a photothermographic recording material, said photo-addressable thermally developable element comprising photosensitive silver halide, a substantially light-insensitive silver salt of an aliphatic carboxylic acid with greater than 12 carbon atoms, a reducing agent therefor in thermal working relationship therewith and a binder, comprising the steps of: (i) preparing a first aqueous dispersion comprising an ex-situ photosensitive silver halide and a substantially light-insensitive silver salt of an aliphatic carboxylic acid with greater than 12 carbon atoms, comprising the steps of: separately preparing a second aqueous dispersion comprising said ex-situ photosensitive silver halide and third aqueous dispersion comprising said substantially light-insensitive silver salt of an organic carboxylic acid; and mixing said second aqueous dispersion with said third aqueous dispersion to produce a mixture thereof, wherein said first aqueous dispersion thereby produced is substantially free of a water-soluble metal or ammonium salt of an aliphatic carboxylic acid with greater than 12 carbon atoms and said process further comprises a step selected from the group consisting of: increasing the pH of said second aqueous dispersion to a value of at least 8.0 prior to mixing with said third aqueous dispersion; increasing the pH of said third aqueous dispersion to a value of at least 8.0 prior to mixing with said second aqueous dispersion; and increasing the pH of said mixture to a value of at least 8.0; and (ii) coating said first aqueous dispersion on a support.

9. A preparation process for a fourth aqueous dispersion comprising a second in-situ photosensitive silver halide and a substantially light-insensitive silver salt of an aliphatic carboxylic acid with greater than 12 carbon atoms, comprising the steps of: (i) providing a third aqueous dispersion comprising said substantially light-insensitive silver salt of an aliphatic carboxylic acid with greater than 12 carbon atoms and (ii) partially converting said substantially light-insensitive silver salt of an aliphatic carboxylic acid with greater than 12 carbon atoms in said third aqueous dispersion with a non-fluoro halide ion source into said second in-situ photosensitive silver halide thereby producing said fourth aqueous dispersion; wherein said fourth aqueous dispersion thereby produced is substantially free of a water-soluble metal or ammonium salt of an aliphatic carboxylic acid with greater than 12 carbon atoms and said process further comprises a step selected from the group consisting of: increasing the pH of said third aqueous dispersion to a value of at least 8.0 prior to step (ii); increasing the pH of the third aqueous dispersion to a value of at least 8.0 during step (ii); and increasing the pH of said aqueous dispersion resulting from step (ii) to a value of at least 8.0.

10. Preparation process according to claim 9, wherein said pH value of at least 8.0 is attained by addition of ammonia.

11. Preparation process according to claim 9, wherein said process further includes a step of adding a water-soluble silver salt having a solubility in water at 20° C. of greater than 0.1 g/L at any stage in said preparation process.

12. A fourth aqueous dispersion comprising a second in-situ photosensitive silver halide and a substantially light-insensitive silver salt of an aliphatic carboxylic acid with greater than 12 carbon atoms and having a pH at or above 8.0 obtained by a process comprising the steps of: (i) providing a third aqueous dispersion comprising said substantially light-insensitive silver salt of an aliphatic carboxylic acid with greater than 12 carbon atoms and (ii) partially converting said substantially light-insensitive silver salt of an aliphatic carboxylic acid with greater than 12 carbon atoms in said third aqueous dispersion with a non-fluoro halide ion source into said second in-situ photosensitive silver halide thereby producing said fourth aqueous dispersion; wherein said fourth aqueous dispersion thereby produced is substantially free of a water-soluble metal or ammonium salt of an aliphatic carboxylic acid with greater than 12 carbon atoms and said process further comprises a step selected from the group consisting of: increasing the pH of said third aqueous dispersion to a value of at least 8.0 prior to step (ii); increasing the pH of the third aqueous dispersion to a value of at least 8.0 during step (ii); and increasing the pH of said aqueous dispersion resulting from step (ii) to a value of at least 8.0.

13. Fourth aqueous dispersion according to claim 12, wherein said fourth aqueous dispersion further contains a reducing agent for said substantially light-insensitive silver salt of an aliphatic carboxylic acid with greater than 12 carbon atoms.

14. A process for preparing a layer of a photo-addressable thermally developable element of a photothermographic recording material, said photo-addressable thermally developable element comprising photosensitive silver halide, a substantially light-insensitive silver salt of an aliphatic carboxylic acid with greater than 12 carbon atoms, a reducing agent therefor in thermal working relationship therewith and a binder, comprising the steps of: (i) preparing a fourth aqueous dispersion comprising a second in-situ photosensitive silver halide and a substantially light-insensitive silver salt of an aliphatic carboxylic acid with greater than 12 carbon atoms, comprising the steps of: (I) providing a third aqueous dispersion comprising said substantially light-insensitive silver salt of an aliphatic carboxylic acid with greater than 12 carbon atoms and (II) partially converting said substantially light-insensitive silver salt of an aliphatic carboxylic acid with greater than 12 carbon atoms in said third aqueous dispersion with a non-fluoro halide ion source into said second in-situ photosensitive silver halide thereby producing said fourth aqueous dispersion; wherein said fourth aqueoud dispersion thereby produced is substantially free of a water-solube metal or ammonium salt of an aliphatic carboxylic acid with greater than 12 carbon atoms and said process further comprises a step selected from the group consisting of: increasing the pH of said third aqueous dispersion to a value of at least 8.0 prior to step (II); increasing the pH of third aqueous dispersion to a value of at least 8.0 during step (II); and increasing the pH of said aqueous dispersion resulting from step (II) to a value of at least 8.0; and (ii) coating said fourth aqueous dispersion on a support.

15. A photothermographic recording material comprising a photo-addressable thermally developable element, wherein the photo-addressable thermally developable element comprises a layer produced with a first dispersion, wherein the first aqueous dispersion comprises an ex-situ photosensitive silver halide and a substantially light-insensitive silver salt of an aliphatic carboxylic acid with greater than 12 carbon atoms, and wherein the first aqueous dispersion has a pH at or above 8.0 and is obtained by a preparation process for a first aqueous dispersion comprising the steps of: separately preparing a second aqueous dispersion comprising said ex-situ photosensitive silver halide and a third aqueous dispersion comprising said substantially light-insensitive silver salt of an aliphatic carboxylic acid with greater than 12 carbon atoms; and mixing said second aqueous dispersion with said third aqueous dispersion to produce a mixture thereof, wherein said first aqueous dispersion thereby produced is substantially free of a water-soluble metal or ammonium salt of an aliphatic carboxylic acid with greater than 12 carbon atoms and said process further comprises a step selected from the group consisting of: increasing the pH of said second aqueous dispersion to a value of at least 8.0 prior to mixing with said third aqueous dispersion; increasing the pH of said third aqueous dispersion to a value of at least 8.0 prior to mixing with said second aqueous dispersion; and increasing the pH of said mixture to a value of at least 8.0.

16. A photothermographic recording material comprising a photo-addressable thermally developable element, wherein the photo-addressable thermally developable element comprises a layer produced with a fourth aqueous dispersion, wherein said fourth aqueous dispersion comprises a second in-situ photosensitive silver halide and a substantially light-insensitive silver salt of an aliphatic carboxylic acid with greater than 12 carbon atoms and wherein the fourth aqueous dispersion has a pH at or above 8.0 and is obtained by a preparation process comprising the steps of: (i) providing a third aqueous dispersion comprising said substantially light-insensitive silver salt of an aliphatic carboxylic acid with greater than 12 carbon atoms and (ii) partially converting said substantially light-insensitive silver salt of an aliphatic carboxylic acid with greater than 12 carbon atoms in said third aqueous dispersion with a non-fluoro halide ion source into said second in-situ photosensitive silver halide thereby producing said fourth aqueous dispersion; wherein said fourth aqueous dispersion thereby produced is substantially free of a water-soluble metal or ammonium salt of an aliphatic carboxylic acid with greater than 12 carbon atoms and said process further comprises a step selected from the group consisting of: increasing the pH of said third aqueous dispersion to a value of at least 8.0 prior to step (ii); increasing the pH of the third aqueous dispersion to a value of at least 8.0 during step (ii); and increasing the pH of said aqueous dispersion resulting from step (ii) to a value of at least 8.0, wherein said process further includes a step of adding a water-soluble silver salt having a solubility in water at 20° C. of greater than 0.1 g/L at any stage in said preparation process.

17. A photothermographic recording material comprising a photo-addressable thermally developable element, wherein the photo-addressable thermally developable element comprises a layer produced with a first aqueous dispersion, wherein the first aqueous dispersion comprises an ex-situ photosensitive silver halide and a substantially light-insensitive silver salt of an aliphatic carboxylic acid with greater than 12 carbon atoms, and wherein the first aqueous dispersion has a pH at or above 8.0 and is obtained by a preparation process for a first aqueous dispersion comprising the steps of: separately preparing a second aqueous dispersion comprising said ex-situ photosensitive silver halide and a third aqueous dispersion comprising said substantially light-insensitive silver salt of an aliphatic carboxylic acid with greater than 12 carbon atoms; and mixing said second aqueous dispersion with said third aqueous dispersion to produce a mixture thereof, wherein said first aqueous dispersion thereby produced is substantially free of a water-soluble metal or ammonium salt of an aliphatic carboxylic acid with greater than 12 carbon atoms and said process further comprises a step selected from the group consisting of: increasing the pH of said second aqueous dispersion to a value of at least 8.0 prior to mixing with said third aqueous dispersion; increasing the pH of said third aqueous dispersion to a value of at least 8.0 prior to mixing with said second aqueous dispersion; and increasing the pH of said mixture to a value of at least 8.0, wherein said process further includes a step of adding a water-soluble silver salt having a solubility in water at 20° C. of greater than 0.1 g/L at any stage in said preparation process.

* * * * *